US006702626B2

(12) United States Patent
Ichio

(10) Patent No.: US 6,702,626 B2
(45) Date of Patent: Mar. 9, 2004

(54) CONNECTOR

(75) Inventor: Toshifumi Ichio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/298,760

(22) Filed: Nov. 15, 2002

(65) Prior Publication Data

US 2003/0096539 A1 May 22, 2003

(30) Foreign Application Priority Data

Nov. 22, 2001 (JP) ..... 2001-357636

(51) Int. Cl.[7] ..... H01R 13/436
(52) U.S. Cl. ..... 439/752
(58) Field of Search ..... 439/752, 595

(56) References Cited

U.S. PATENT DOCUMENTS 5,562,500 A * 10/1996 Tsukakoshi ..... 439/752
5,797,772 A * 8/1998 Sakurai et al. ..... 439/752
5,820,421 A * 10/1998 Makino ..... 439/752
5,863,224 A * 1/1999 Saba et al. ..... 439/752
6,036,552 A * 3/2000 Atsumi ..... 439/752
6,139,375 A * 10/2000 Konoya et al. ..... 439/752
6,390,859 B2 * 5/2002 Furutani ..... 439/752
6,435,919 B1 * 8/2002 Saka et al. ..... 439/752

* cited by examiner

*Primary Examiner*—Gary Paumen
(74) *Attorney, Agent, or Firm*—Anthony J. Casella; Gerald E. Hespos

(57) ABSTRACT

A connector has a housing (10) with a retainer (20) that can be moved between partial and full locking positions on the housing (10). The retainer (20) has resilient locking pieces (24F, 24R) formed with full locking projections (26F, 26R) and partial locking projections (25) that move over corresponding fastening projections (15F, 15R) on the housing (10) to lock the retainer (30) in the partial and full locking positions. Free ends (24*a*) of the resilient locking pieces (24F, 24R) are engageable with one another to limit deformation of the resilient locking pieces (24F, 24R) and to prevent detachment of the retainer (20) from the housing (10).

9 Claims, 7 Drawing Sheets

CONNECTOR

BACKGROUND OF THE INVENTION

1. Field of the Invention

The invention relates to a connector provided with a retainer for locking terminal fittings.

2. Description of the Related Art

Japanese Unexamined Utility Model Publication No. 6-58570 discloses a known connector with a housing and a retainer that is mounted on the housing for movement from a partial mounting position to a full locking position. Terminal fittings can be inserted into the housing and partially locked when the retainer is in the partial mounting position. The retainer then is pushed to the full locking position for doubly locking terminal fittings.

The retainer and the housing have means for locking the retainer at the partial locking position and at the full locking position. Specifically, the retainer has a resilient locking piece that extends parallel to the pushing direction of the retainer from the partial locking position to the full locking position. A partial locking projection is formed at a leading end of the resilient locking piece and a full locking projection is formed more toward the base end of the resilient locking piece than the partial locking projection. The housing is formed with one fastening projection common to both partial and full locking projections.

The fastening projection is held between the partial locking projection and the full locking projection when the retainer is in the partial locking position. The retainer then can be pushed to the full locking position. The pushing force causes the full locking projection to deform away from the fastening projection and then to move over the fastening projection. Thus, the resilient locking piece engages the fastening projection to prevent a returning movement of the retainer toward the partial locking position.

A jig can be used to return the retainer from the full locking position to the partial locking position so that the terminal fitting can be withdrawn from the housing. As a result, the resilient locking piece deforms and the full locking projection disengages from the fastening projection. The resilient locking piece is restored resiliently as the full locking projection moves over the fastening projection. As a result, the fastening projection is held between the full and partial locking projections and in the partial locking position.

An excessively large force must be exerted on the retainer during the retainer returning operation because of the need to disengage the full locking projection from the fastening projection and the need to deform the resilient locking piece against its resilient force. There is a possibility that the large force required to move the retainer back to the partial locking position will inadvertently drive the partial locking projection over the fastening projection. Thus, the retainer may come out of the housing.

The invention was developed in view of the above problem and an object thereof is to prevent a retainer from coming out of a housing when the retainer is moved from a full locking position to a partial locking position.

SUMMARY OF THE INVENTION

The invention relates to a connector with a housing and a retainer that is moveable between first and second positions on the housing. At least one terminal fitting is inserted into the housing when the retainer is at the first position. The retainer then can be pushed to the second position to lock the terminal fitting in the housing. At least one resilient locking piece is cantilevered on the retainer and extends substantially in the pushing direction of the retainer from the first position to the second position. A first projection is near the free end of the resilient locking piece and a second projection is closer to the base end of the resilient locking piece. A fastening projection is formed in the housing and causes the resilient locking piece to deflect as the retainer is moved between the first and second positions. However, the resilient locking piece is restored resiliently when the retainer is in either of the first or second positions. Thus, the fastening projection engages the first projection when the retainer is in the first position and engages the second projection when the retainer is in the second position. A preventing means is provided for limiting deflection of the resilient locking piece when the first projection is engaged with the fastening projection, and hence prevents the retainer from disengaging from the housing in response to forces exerted for moving the retainer from the second position to the first position.

The fastening projection is engaged between the first and second projections to prevent loose movement of the retainer from the first position.

The second projection preferably is engageable with the free end side fastening projection to restrict the retainer from making a return movement toward the first position.

The preventing means prevents the free end of the resilient locking piece from displacing in response to forces in a direction for detaching the retainer from the housing. Thus, the resilient locking piece effectively is supported at both ends instead of being supported only at the base end. Accordingly, an apparent resilient force of the resilient locking piece is high, and deformation of the resilient locking piece is more difficult. The preventing means also prevents the first projection from moving over the fastening projection as the resilient locking piece is deformed resiliently. As a result, the retainer can be held at the first position.

Preferably, the second projection projects from the resilient locking piece less than the first projection.

The resilient locking piece is supported only at one end and is angularly displaceable. Thus, if the projecting distances of the first and second projections are equal, a degree of inclination of the resilient locking piece is larger when the first projection (closer to the free end) moves over the fastening projection than when the second projection (more distant from the free end) moves over the fastening projection. Therefore a larger force is required to move the retainer from the second position to the first position, and a design with equal projecting distances of the first and second projections is not preferable in view of operability.

In this respect, the projecting distance of the second projection is smaller than the projecting distance of the first projection according to the preferred embodiment. Thus, improved operability can be realized by reducing the force required to move the retainer between the second position and the first position while still preventing detachment of the retainer from the housing.

The free ends of the resilient locking pieces preferably are brought substantially into contact to restrict displacements of the free ends.

Two resilient locking pieces and two fastening projections preferably are provided and are substantially symmetrical. Thus, the free ends of the resilient locking pieces contact each other to restrict displacements of the free ends when the resilient locking pieces try to deform in directions that would disengage the first projections from the fastening projections with the retainer held at the first position.

The preventing means preferably is formed only by the resilient locking piece of the retainer, and the housing needs no preventing means. Thus, the housing has a simpler shape.

The second projections preferably are substantially symmetrically to each other.

The projecting distance of one of the second projections preferably is different than the projecting distance of the other of the second projections.

The retainer preferably is inserted into the housing at an angle to the inserting direction of the terminal fitting into the housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
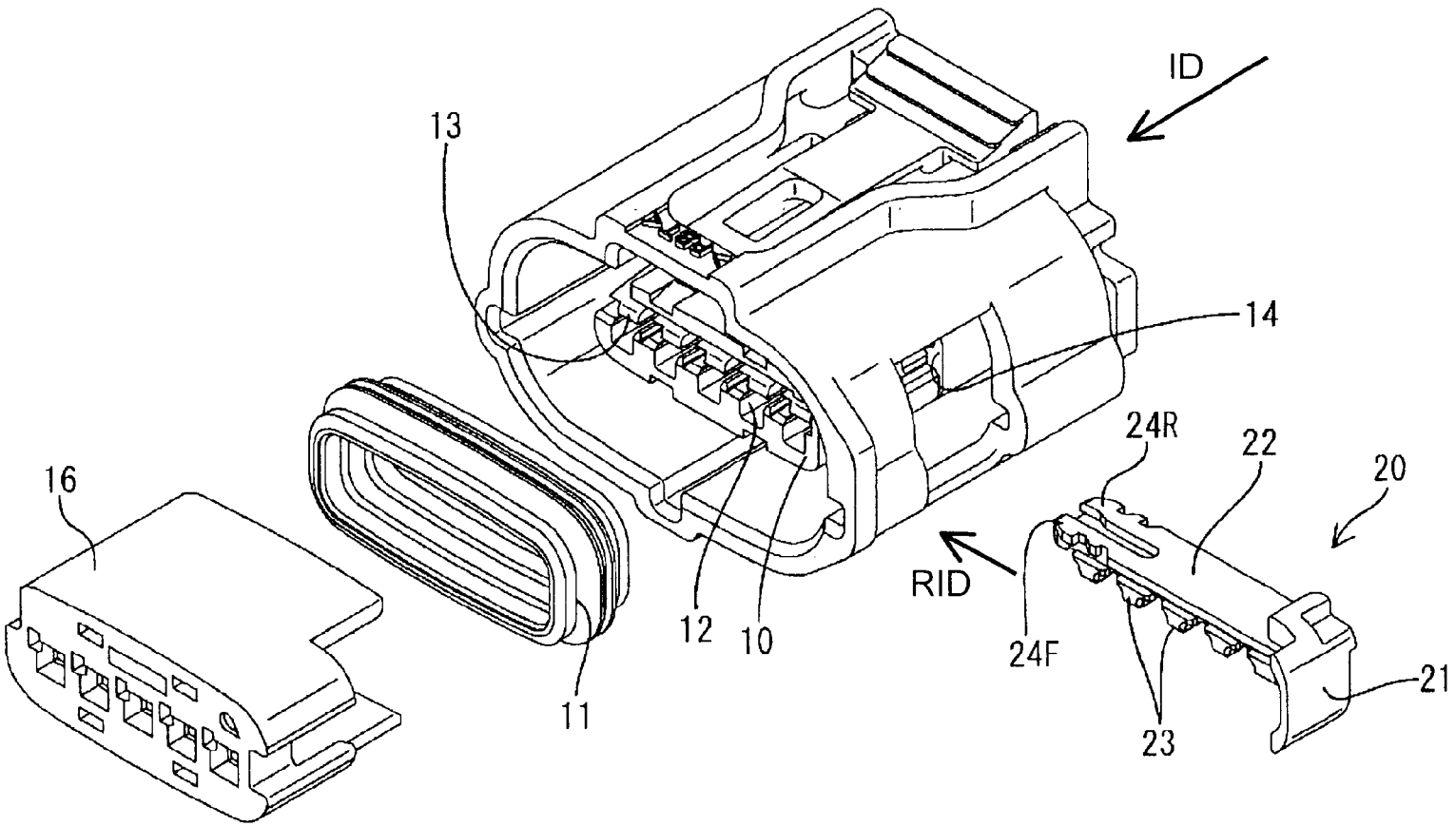
FIG. 1 is an exploded perspective view of a connector according to one embodiment of the invention.
Figure 2:
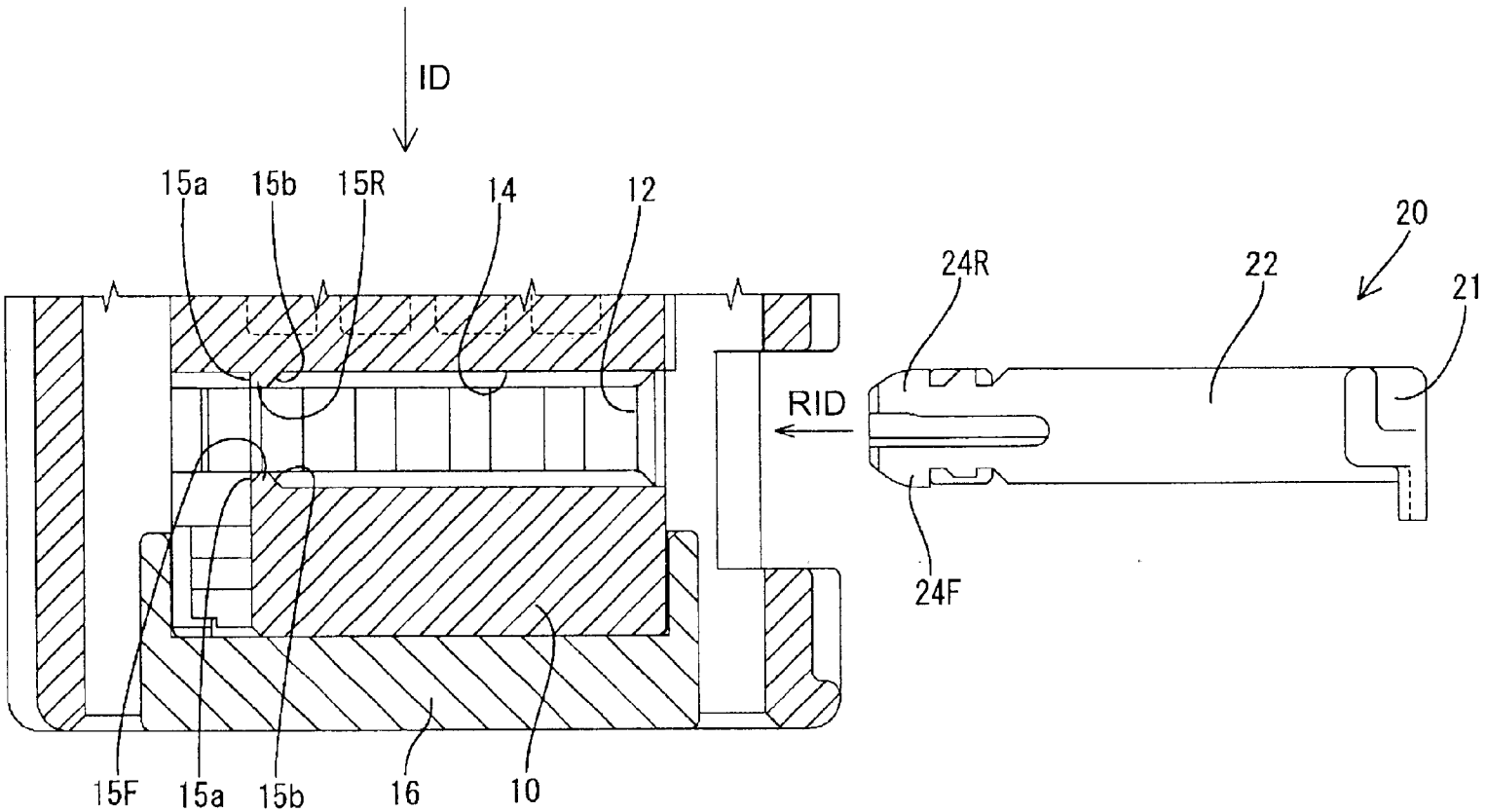
FIG. 2 is a horizontal section showing a state where a retainer is detached from a housing.

A connector according to the invention includes a housing 10, a retainer 20 and terminal fittings 30, as shown in FIGS. 1 to 11. The housing 10 is made e.g. of a synthetic resin, and a sealing member 11 is mounted on the outer peripheral surface of the housing 10 for sealing a portion to be connected with a mating connector (not shown). Cavities 12 are formed at substantially a front half of the housing 10, and a front holder 16 is fit to the front of the housing 10 for locking the sealing member 11 in the housing 10.

The terminal fittings 30 are inserted into the cavities 12 from behind along an inserting direction ID. Each terminal fitting 30 has a first lock 31 engaged with a cavity lock 13 in the cavity 12 and a second lock 32 that faces an accommodation space 14 from the front when the terminal fitting 30 is inserted properly.

The accommodation space 14 extends transversely into the left side surface of the housing 10 substantially normal to the inserting direction ID and communicates with each cavity 12. The retainer 20 is inserted into the accommodation space 14 from the left side of the housing 10 along a retainer inserting direction RID that is substantially normal to the inserting direction ID. A first fastening projection 15F projects back from the front inner surface at the right end of the accommodation space 14, and a second fastening projection 15R projects forward from the rear inner surface. The first and second fastening projections 15F, 15R have substantially the same shape and dimensions and are substantially symmetric along forward and backward directions. Receiving surfaces 15*a* are formed at the left surfaces of the fastening projections 15F, 15R and extend substantially normal to the inserting direction RID of the retainer 20 into the accommodation space 14, whereas slanted guide surfaces 15*b* are formed at the right surfaces thereof and are aligned oblique to the inserting direction RID of the retainer 20.

Figure 6:
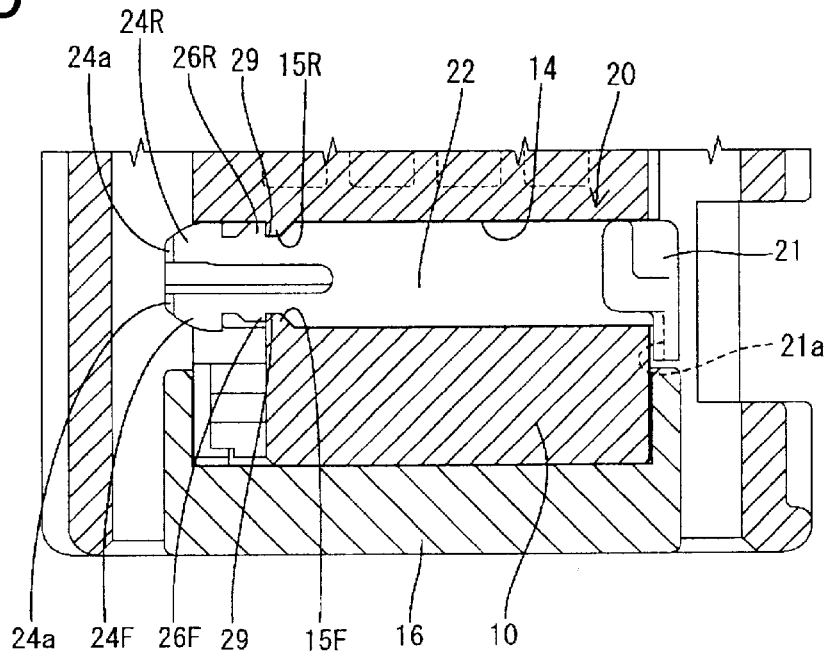
FIG. 6 is a horizontal section showing a state where the retainer is mounted at a full locking position in the housing.
Figure 7:
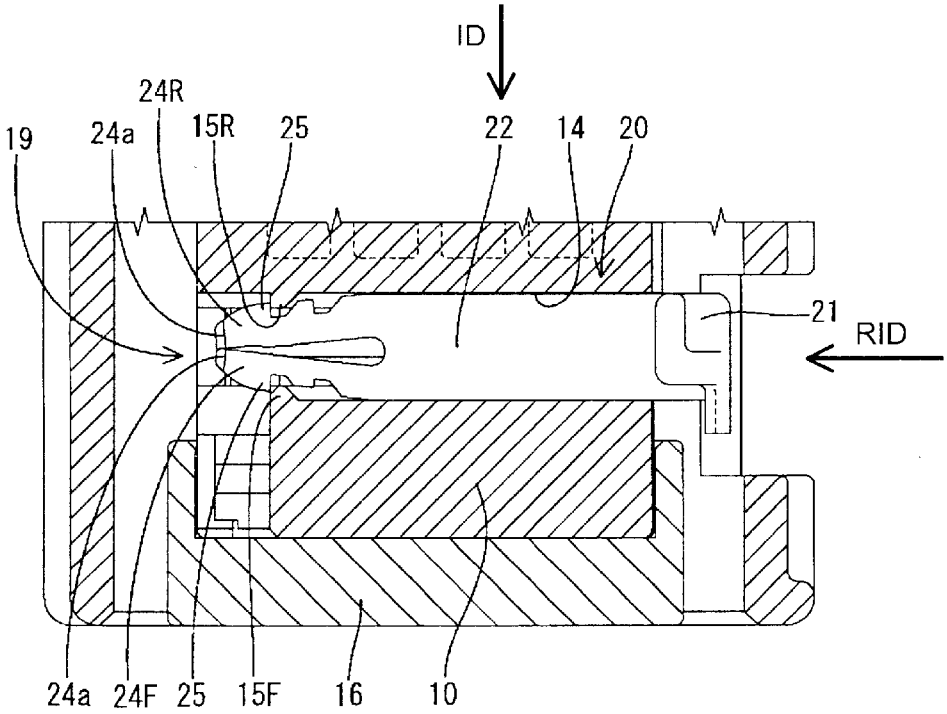
FIG. 7 is a horizontal section showing a state immediately after the retainer at the full locking position is moved to the partial locking position.
Figure 8:
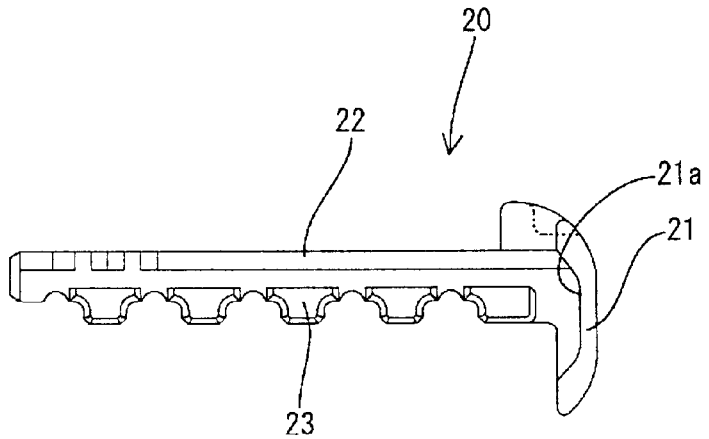
FIG. 8 is a front view of the retainer.
Figure 9:
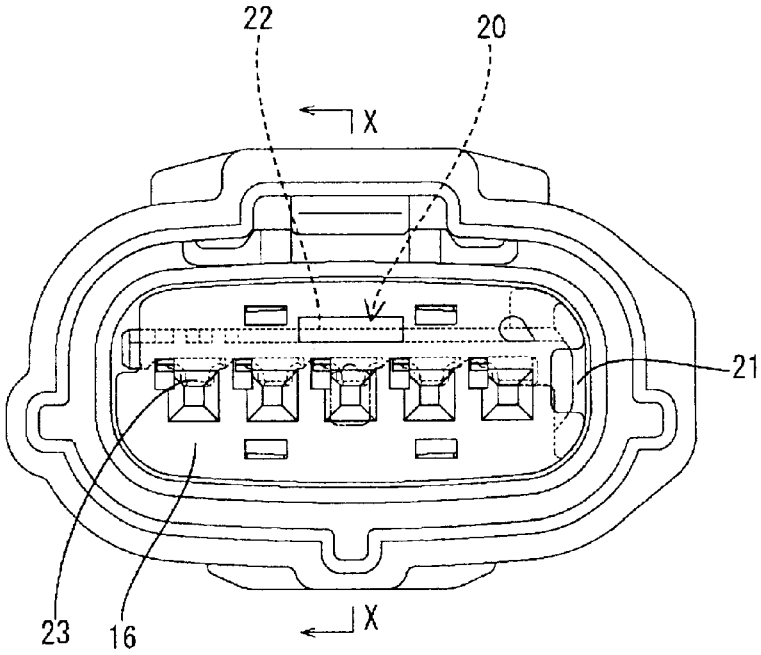
FIG. 9 is a front view of the connector.
Figure 10:
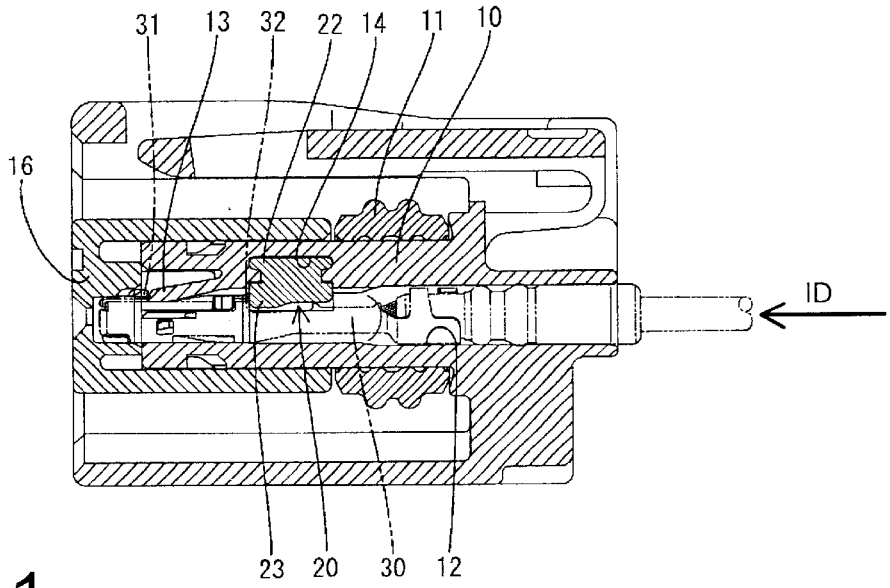
FIG. 10 is a section along 10—10 of FIG. 9.

The retainer 20 can be inserted into a partial locking or first position (see FIG. 4) in the accommodation space 14 of the housing 10 and then can be pushed further along the retainer inserting direction RID to a full locking or second position (see FIG. 6). The retainer 20 is made e.g. of a synthetic resin, and has a base 21 shaped to conform substantially to the outer side surface of the housing 10, and an extending portion 22 that extends from the base 21 in substantially the same direction as the inserting direction RID into the accommodation space 14. The extending portion 22 is a substantially flat plate and has terminal locks 23 on its lower surface for engaging the second locks 32 of the terminal fittings 30 in the cavities 12 when the retainer 20 is at the full locking position. The terminal locks 23 are retracted from the cavities 12 and outside the insertion paths of the terminal fittings 30 when the retainer 20 is at the partial locking position. Thus, the terminal fittings 30 can be inserted into and withdrawn from the cavities 12 along the inserting direction ID.

Front and rear resilient locking pieces 24F, 24R are formed at the end of the extending portion 22 remote from the base 21 for locking the retainer 20 at the partial locking position and at the full locking position.

The front resilient locking piece 24F is at the front side of the extending portion 22 and extends substantially along the inserting direction RID of the retainer 20. The front resilient locking piece 24F is resiliently deformable along a deformation direction DD with a base end as a supporting point so that a free end 24*a* is displaced backward. Partial and full locking projections 25 and 26F project forward from the front edge of the front resilient locking piece 24F.

The partial locking projection 25 is at the free end 12*a* of the front resilient locking piece 24F, and has a guide surface 25*a* and a locking surface 25*b*. The guide surface 25*a* extends oblique to the inserting direction RID of the retainer 20 at the leading side of the partial locking projection 25 with respect to the inserting direction RID of the retainer 20. The locking surface 25*b* extends substantially normal to the inserting direction RID of the retainer 20 at a side of the partial locking projection 25 that faces the base end of the front resilient locking piece 24F.

The full locking projection 26F is more toward the base end of the front resilient locking piece 24F than the partial locking projection 25, and a partial locking recess 27 (FIG. 4) is defined between the full locking projection 26F and the partial locking projection 25 for receiving the fastening projection 15F of the housing 10. The full locking projection 26F has a guide surface 26*a* and a locking surface 26*b*. The guide surface 26*a* extends oblique to the inserting direction RID of the retainer 20 and is at a leading side of the full locking projection 26F with respect to the inserting direction RID of the retainer 20. The locking surface 26*b* is substantially normal to the inserting direction RID of the retainer 20 and is at a side of the full locking projection 26F that faces the base end of the front resilient locking piece 24F. A full locking surface 28 is formed more toward the base end than the full locking projection 26F, and a full locking recess 29 is defined between the full locking projection 26F and the full locking surface 28 for receiving the fastening projection 15F of the housing 10.

Figure 11:
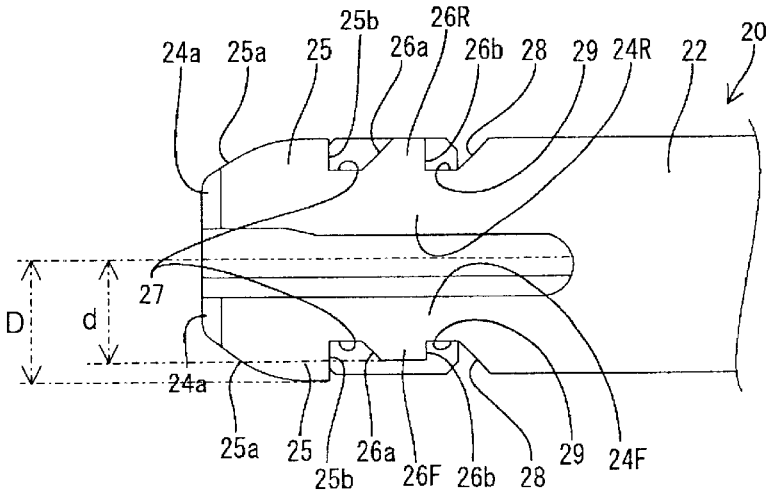
FIG. 11 is a partial enlarged plan view of the retainer.

A projecting distance d of the full locking projection 26F from the central axis of the extending portion 22 is less than the projecting distance D of the partial locking projection 25 from the central axis of the extending portion 22 (see e.g. FIG. 11). Thus, the front-end surface of the full locking projection 26F is located more backward than that of the partial locking projection 25 with respect to the inserting direction ID of the terminal fittings 30.

The rear resilient locking piece 24R also extends substantially along the inserting direction RID of the retainer 20, but along the rear side of the extending portion 22. The rear resilient locking piece 24R is resiliently inclinable with a base end as a supporting point such that a free end 24*a* is displaced forward toward the first resilient locking piece 24F. The second resilient locking piece 24R has partial and full locking projections 25 and 26R that project back with respect to the inserting direction ID of the terminal fittings 30 from the rear edge of the rear resilient locking piece 24R.

The partial locking projection 25 is at the free end 12*a* of the rear resilient locking piece 24R, and has a guide surface 25*a* and a locking surface 25*b*. The guide surface 25*a* extends oblique to the inserting direction RID of the retainer 20 at the leading end of the rear resilient locking piece 24R with respect to the inserting direction RID of the retainer 20. The locking surface 25*b* is substantially normal to the inserting direction RID of the retainer 20 at a side of the partial locking projection 25 that faces the base end of the rear resilient locking piece 24R.

The full locking projection 26R is more toward the base end of the rear resilient locking piece 24R than the partial locking projection 25, and a partial locking recess 27 is defined between the full locking projection 26R and the partial locking projection 25 for receiving the fastening projection 15R of the housing 10. The full locking projection 26R has a guide surface 26*a* and a locking surface 26*b*. The guide surface 26*a* extends oblique to the inserting direction RID of the retainer 20 and is at a leading side of the full locking projection 26R with respect to the inserting direction RID of the retainer 20. The locking surface 26*b* extends substantially normal to the inserting direction RID of the retainer 20 and is at a side of the full locking projection 26R that faces the base end of the rear resilient locking piece 24R. A full locking surface 28 is formed more toward the base end than the full locking projection 26R, and a full locking recess 29 is defined between the full locking projection 26R and the full locking surface 28 for receiving the fastening projection 15R of the housing 10.

At the second resilient locking piece 24R, A projecting distance of the full locking projection 26R from the central axis of the rear resilient locking piece 24R is substantially equal to the projecting distance of the partial locking projection 25 from the central axis of the rear resilient locking piece 24R (see e.g. FIG. 11). Thus, the rear end surface of the full locking projection 26R and the rear end surface of the partial locking projection 25 are substantially flush with each other along a direction parallel with the inserting direction RID of the retainer 20. Further, the projecting distance of the partial locking projection 25 of the rear resilient locking piece 24R is substantially equal to that of the partial locking projection 25 of the front resilient locking piece 24F.

Figure 3:
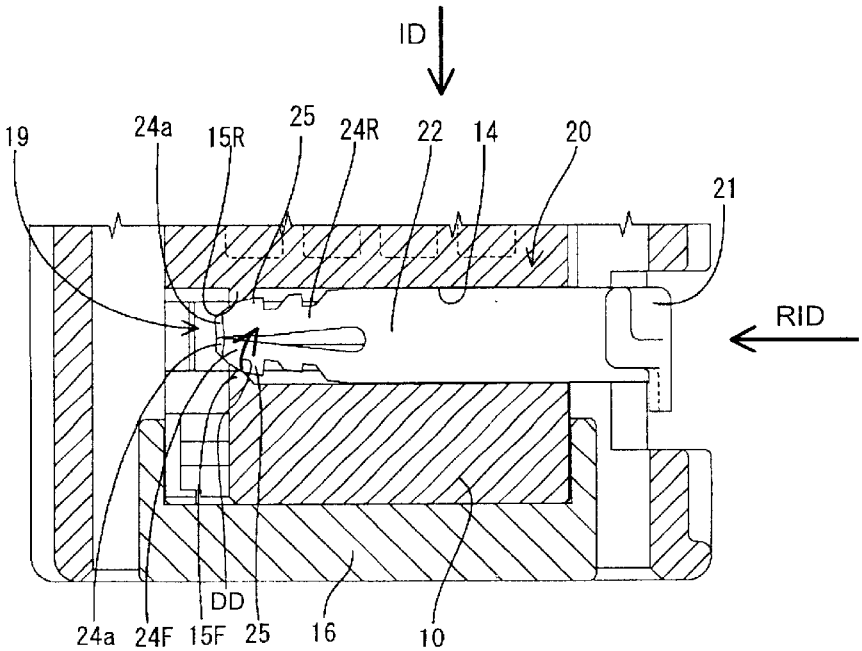
FIG. 3 is a horizontal section showing an intermediate stage of mounting the retainer into the housing.

The connector is assembled by inserting the retainer 20 into the accommodation space 24. The resilient locking pieces 24F, 24R deform toward each other during this insertion to bring the front ends 24*a* of the resilient locking pieces substantially into contact, as shown in FIG. 3. As a result, the partial locking projections 25 can move over the corresponding fastening projections 15F, 15R. Sufficient insertion of the retainer 20 enables the partial locking projections 25 to pass the fastening projections 15F, 15R. Thus, the resilient locking pieces are restored resiliently and the fastening projections 15F, 15R engage in the partial locking recesses 27 between the partial locking projections 25 and the full locking projections 26F, 26R to hold the retainer 20 at the partial locking position (see FIG. 4).

Assembly proceeds by inserting the terminal fittings 30 into the respective cavities 12 in the inserting direction ID. As a result, the locks 13 in the cavities 12 engage the locks 31 on the inserted terminal fittings 30.

Figure 5:
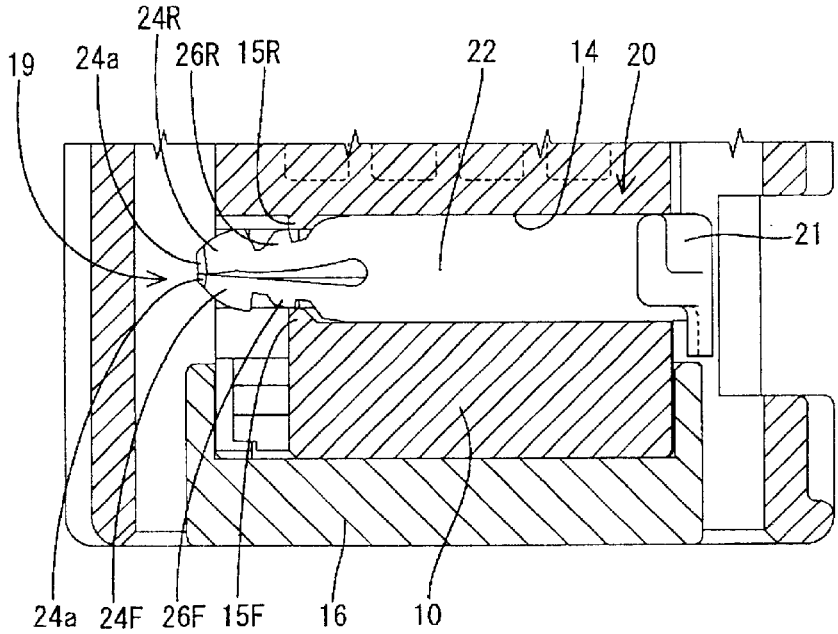
FIG. 5 is a horizontal section showing an intermediate stage of a movement of the retainer between the partial and full locking position.

The retainer 20 then is pushed in the insertion direction RID from the partial locking position to the full locking position. The resilient locking pieces 24F, 24R deform toward each other during this pushing process to bring the front ends 24*a* thereof into contact, as shown in FIG. 5. As a result, the full locking projections 26F, 26R move over the corresponding fastening projections 15F, 15R. The resilient locking pieces 24F, 24R are restored resiliently when the full locking projections 26F, 26R pass the fastening projections 15F, 15R. Thus, the fastening projections 15F, 15R engage the full locking recesses 29 between the full locking projections 26F, 26R and the full locking surfaces 28. As a result, the retainer 20 is held at the full locking position (see FIG. 6). In this state, the terminal locks 23 of the retainer 20 engage the second locks 32 of the terminal fittings 30 for locking. The terminal fittings 30 are held securely by the engagement of the terminal locks 23 and the second locks 32 and the engagement of the locks 13 and the first locks 31.

The locked terminal fitting 30 can be withdrawn from the housing 10 by returning the retainer 20 from the full locking position to the partial locking position. This movement is achieved by inserting the leading end of a narrow jig (not shown) into a jig receiving portion 21*a* of the base 21. The full locking projections 26F, 26R are disengaged from the fastening projections 15F, 15R by the leverage action of the jig so that the retainer 20 may be moved. The full locking projections 26F, 26R move over the corresponding fastening projections 15F, 15R in the process of moving the retainer 20 to the partial locking position, and the resilient locking pieces 24F, 24R deform toward each other to bring the front ends 24*a* of the resilient locking pieces 24F, 24R substantially into contact, as shown in FIG. 5. The resilient locking pieces 24F, 24R are restored resiliently when the full locking projections 26F, 16R pass the fastening projections 15F, 15R. Thus, the fastening projections 15F, 15R engage in the partial locking recesses 27 to hold the retainer 20 at the partial locking position.

In this way, the secondary locking of the terminal fittings 30 by the retainer 20 is canceled. A jig (not shown) then may be used to disengage the lock 13 from the first lock 31, and the terminal fitting 30 may be withdrawn.

An excessively large force could be exerted on the retainer 20 as the retainer 20 is moved from the full locking position toward the partial locking position with force. Therefore, there is a danger that such a force could inadvertently deform the resilient locking pieces 24F, 24R again and drive the partial locking projections 25 over the fastening projections 15F, 15R. Hence, the retainer 20 could come out of the housing 10 without stopping at the partial locking position.

However, a preventing means 19 limits displacements of the free ends 24*a* of the resilient locking pieces 24F, 24R. More particularly, the free ends 24*a* of the resilient locking pieces 24F, 24R are brought substantially into direct contact (see FIG. 7) while the partial locking projections 25 are still engaged with the fastening projections 15F, 15R. The restriction on the displacements of the free ends 24*a* makes the resilient locking pieces 24F, 24R supported at both the base ends and the free ends 24*a* instead of being supported only at the base ends. This increases apparent resilient forces of the resilient locking pieces 24F, 24R and makes it difficult for the resilient locking pieces 24F, 24R to undergo resilient deformation. This also prevents the partial locking projections 25 from moving over the fastening projections 15F, 15R as the resilient locking pieces 24F, 24R are deformed. As a result, the retainer 20 can be held at the partial locking position.

Accordingly, deformation of the resilient locking pieces 24F, 24R is restricted when the full locking projections 26F, 26R move over the fastening projections 15F, 15R and the resilient locking pieces 24F, 24R are restored resiliently upon the arrival of the retainer 20 at the partial locking position. Thus, the partial locking projections 25 cannot move over the fastening projections 15F, 15R. The retainer 20, therefore, stops securely at the partial locking position, with the fastening projections 15F, 15R held between the full locking projections 26F, 26R and the partial locking projections 25. As a result, the retainer 20 cannot be detached from the housing 10.

The resilient locking pieces 24F, 24R each are supported at only one end and are inclinably displaceable. The partial locking projections 25 and full locking projections 26F, 26R could be made with equal projecting distances. In this situation, the degree of deformation of the resilient locking pieces 24F, 24R would be larger when the full locking projections 26F, 26R, which are more distant from the free ends 24*a*, move over the fastening projections 15F, 15R. This would mean that a larger force would be required to move the retainer 20 from the full locking position to the partial locking position. Such a construction would not provide preferable operability for moving the retainer 20 from the partial locking position to the full locking position nor for preventing detachment of the retainer 20 from the housing 10.

However, the projecting distance d of the full locking projection 26F is less than the projecting distance D of the partial locking projection 25 on the front resilient locking piece 24F of this embodiment. Therefore, an improved operability can be realized by reducing a force required to move the retainer 20 between the full locking position and the partial locking position without reducing a function of preventing the detachment of the retainer 20 from the housing 10.

The means for restricting displacement of the free ends 24*a* of the resilient locking pieces 24F, 24R is realized by bringing the free ends 24*a* of the resilient locking pieces 24F, 24R into direct contact. Thus, no preventing means is required on the housing 10, and the housing 10 has a simpler shape.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the pair of the resilient locking pieces and the pair of the fastening projections are substantially symmetrical in the foregoing embodiment, only one resilient locking piece and only one resilient fastening projection may be provided according to the present invention. In such a case, the displacement of the free end of the resilient locking piece is prevented by bring the free end into contact with the housing.

The free ends contact to restrict displacement of the resilient locking pieces in the foregoing embodiment. However, the housing may have a receiving portion to be positioned between the resilient locking pieces for restricting displacement of the free ends.

The projecting distance of one full locking projection is less than that of the corresponding partial locking projection in the foregoing embodiment. However, the former projecting distance may be set equal to or larger than the latter projecting distance according to the present invention.

Although the projecting distances of the full and partial locking projections are differed on only one of the two resilient locking pieces in the foregoing embodiment, they may be differed in both resilient locking pieces.

What is claimed is:

1. A connector comprising:

a housing (10);

a retainer (20) moveable on the housing (10) along an insertion direction (RID) from a first position (FIG. 4) to a second position (FIG. 6), at least one terminal fitting (30) being insertable into the housing (10) when the retainer (20) is at the first position (FIG. 4), and being locked in the housing (10) when the retainer (20) is pushed from the first position (FIG. 4) to the second position (FIG. 6) to lock the terminal fitting (30);

at least one resilient deformable locking piece (24F) cantilevered on the retainer (20) and extending substantially along the insertion direction (RID), the resilient locking piece (24F) having a free end (24*a*), a partial locking projection (25) formed on the resilient locking piece (24F) near the free end (24*a*), and a full locking projection (26F) formed on the resilient locking piece (24F) further from the free end (24*a*) than the partial locking projection (25);

at least one fastening projection (15F) formed in the housing (10) and engageable with the partial locking projection (25) for holding the retainer in the first position and being engageable with the full locking projection (26F) for holding the retainer (10) in the second position; and a preventing means (19) for limiting deformation of the resilient locking piece (24F) and displacement of the free end (24*a*) relative to the partial locking projection (25) and for substantially preventing disengagement of the retainer (20) from the housing (10).

2. The connector of claim 1, the fastening projection (15F) is engaged between the partial and full locking projections (25, 26F) when the retainer (20) is at the first position (FIG. 4) for preventing loose movements of the retainer (20).

Figure 4:
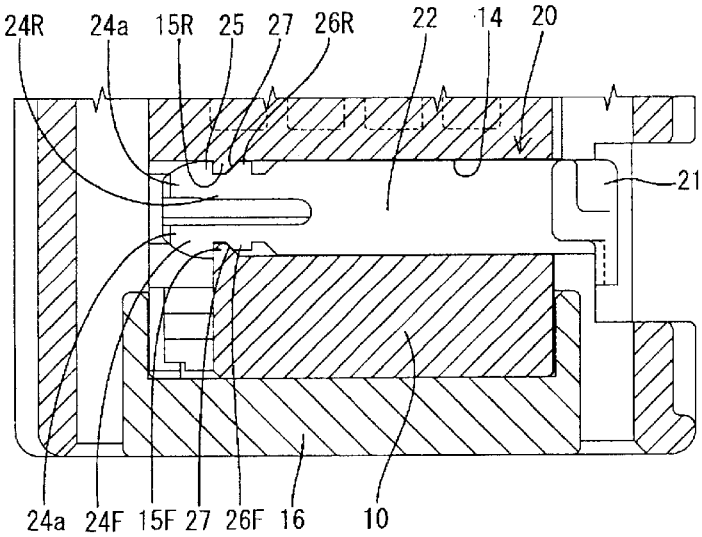
FIG. 4 is a horizontal section showing a state where the retainer is mounted at a partial locking position in the housing.

3. The connector of claim 2, a side of the full locking projection (26F) away from the partial locking projection (25) engages the fastening projection (15F) when the retainer (20) is at the second position (FIG. 6) for preventing the retainer (30) from moving to the first position (FIG. 4).

4. The connector of claim 3, wherein a projecting distance (d) of the full locking projection (26F) on the resilient locking piece (24F) is less than a projecting distance (D) of the partial locking projection (25).

5. The connector of claim 1, wherein the at least one resilient locking piece (24F) comprises two resilient locking pieces (24F, 24R) and the at least one fastening projection comprises two fastening projections (15F, 15R) disposed symmetrically with respect to the insertion direction (RID).

6. The connector of claim 5, wherein the free ends (24*a*) of the resilient locking pieces (24F, 24R) are engageable with each other for defining the preventing means for limiting the displacement of the free ends (24*a*).

7. The connector of claim 6, wherein two full locking projections (26F, 26R) are provided substantially symmetrically to each other.

8. The connector claim 7, wherein the projecting distance (d) of one (26F) of the pair of partial locking projections (26F, 26R) is different than that of the other (26R) of the second position projections (26F, 26R).

9. The connector of claim 1, wherein the inserting direction (RID) of the retainer (20) is substantially normal to an inserting direction (ID) of the terminal fitting (30) into the housing (10).

* * * * *